US006445273B1

(12) United States Patent
Yu

(10) Patent No.: US 6,445,273 B1
(45) Date of Patent: Sep. 3, 2002

(54) OVERLOAD-PROTECTION PUSH-BUTTON SWITCH WITH AUTOMATIC RESETTING MECHANISM

(76) Inventor: Tsung-Mou Yu, No. 4, Alley 2, Lane 23, Sec. 3, Pa-Te Road, Pan-Chiao, Taipei Hsien (TW)

( * ) Notice: Subject to any disclaimer, the term of this patent is extended or adjusted under 35 U.S.C. 154(b) by 141 days.

(21) Appl. No.: 09/697,926

(22) Filed: Oct. 27, 2000

(30) Foreign Application Priority Data

Oct. 29, 1999 (TW) ..... 88218452 U

(51) Int. Cl.[7] ..... H01H 37/02; H01H 37/32; H01H 37/46

(52) U.S. Cl. ..... 337/37; 337/39; 337/59; 337/85; 337/112; 337/113; 337/66; 4/74

(58) Field of Search ..... 337/37, 53, 59, 337/74, 66–69, 75, 76, 79, 85, 39, 91, 112, 113, 140, 333, 334, 345, 379; 200/553–557

(56) References Cited

U.S. PATENT DOCUMENTS

| | | | | | |
|---|---|---|---|---|---|
| 3,358,099 | A | * | 12/1967 | Bellomayre | 200/113 |
| 4,092,623 | A | * | 5/1978 | Kirkup | 337/43 |
| 4,258,349 | A | * | 3/1981 | Flory | 337/46 |
| 4,345,233 | A | * | 8/1982 | Matthies | 337/75 |
| 4,528,538 | A | * | 7/1985 | Andersen | 337/43 |
| 4,661,667 | A | | 4/1987 | Sorimachi et al. | 200/314 |
| 4,704,594 | A | | 11/1987 | Krasser | 337/66 |
| 4,931,762 | A | | 6/1990 | Fierro | 337/66 |
| 4,937,548 | A | | 6/1990 | Sdunek | 337/70 |
| 5,012,495 | A | * | 4/1991 | Munroe et al. | |
| 5,223,813 | A | | 6/1993 | Cambreleng et al. | 337/66 |
| 5,262,748 | A | * | 11/1993 | Tsung-Mou | 337/66 |
| 5,451,729 | A | | 9/1995 | Onderka et al. | 200/18 |
| 5,541,569 | A | * | 7/1996 | Jang | 337/68 |
| 5,760,672 | A | * | 6/1998 | Wang | 337/79 |
| 5,786,742 | A | | 7/1998 | Yin | 337/66 |
| 5,828,284 | A | * | 10/1998 | Huang | 337/37 |
| 5,847,638 | A | * | 12/1998 | Sorenson | 337/380 |
| 5,889,457 | A | * | 3/1999 | Hsu et al. | 337/59 |
| 5,892,426 | A | * | 4/1999 | Huang | 337/59 |
| 5,898,355 | A | * | 4/1999 | Yu | 337/8 |
| 6,072,381 | A | * | 6/2000 | Yu | 337/37 |
| 6,094,126 | A | * | 7/2000 | Sorenson | 337/37 |
| 6,121,868 | A | * | 9/2000 | Chiang | 337/37 |
| 6,154,116 | A | * | 11/2000 | Sorenson | 337/37 |
| 6,229,426 | B1 | * | 5/2001 | Lavado et al. | 337/57 |

FOREIGN PATENT DOCUMENTS

| | | | | |
|---|---|---|---|---|
| CH | 647094 A5 | * | 12/1984 | 337/333 |
| DE | 19534611 A1 | * | 3/1996 | H01H/23/20 |
| EP | 0694947 A1 | * | 1/1996 | H01H/71/54 |

* cited by examiner

*Primary Examiner*—Anatoly Vortman

(57) ABSTRACT

An overload-protection push-button switch with automatic resetting mechanism is disclosed. The switch is characterized in that a pressing stem actuates a conducting leaf via an enabled rocking lever, and that a wrecking bar is provided to dislocate the position of a positioning unit so that the pressing stem will automatically return back to its reset position in case the rocking lever is disabled due to overload. By means of the above structure, a push-button switch which is capable of exactly functioning and has a simple structure to easily assemble is available.

6 Claims, 9 Drawing Sheets

OVERLOAD-PROTECTION PUSH-BUTTON SWITCH WITH AUTOMATIC RESETTING MECHANISM

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a push-button switch and, in particular, to an overload-protection push-button switch with a simple structure capable of actually tripping and automatically going to a reset position in case of overload.

2. Description of the Related Art

There are many types of push-button switches for various applications, such as one having a turn-on indicating lamp and one providing an overload protection function. In terms of one having an overload protection function, there are also several kinds of protection principles or mechanisms being adopted. For example, both the blow-out of a fuse wire and the thermal deformation of a bimetal blade have ever been adopted as a trigger source for an overload protection. However, the fuse wire is not repetitive and thus its utility rate gradually decreases. As for the thermal bimetal blade. there are many kinds of mechanism, such as those disclosed in U.S. Pat. Nos. 5,786,742, 5,223,813, 4,937,548, 4,661,667, 4,931,762, 5,451,729, and 4,704,594.

For example, in the U.S. Pat. No. 5,786,742, a so-called power-cutting member (72) used to alternatively set a set and a reset position of a switch is disclosed. In that case, a bimetallic blade (75) is used to push a shaft seat (71) to trip and automatically reset a switch. However, the contacts in such a switch are directly depressed by a button. Thus, if the button has jammed or pushed down by an external force, they would be kept in its conducting position even if overload occurs. Moreover, such a switch is not economical because of a use of up to four contacts to construct a conducting circuit. It also increases the possibility of generating an arc. Furthermore, it is troublesome in assembly due to a need for connecting a wire between the bimetallic blade (75) and the conducting plate (74).

In U.S. Pat. No. 5,223,813, a bimetal sheet (13), a common trip (17) actuated by the bimetal sheet, and a cam member (27) are incorporated with a rocker actuator (33) to make contact members (7, 1) contact together or separate from each other. In such a patent, the common trip (17) will be displaced in response to a deformation of the bimetal sheet so that the cam member (27) is released and the switch trips. However, even though the common trip is indirectly actuated by a rocker actuator so that a jamming of the rocker actuator or a contact of the contact members by a neglectful re-push after overload can be avoided, such a switch is rather complicated. Moreover, since it needs a wire to connect its cantilever spring (5) and its bimetal sheet (13), its assembly is also troublesome. Furthermore, a fail-action is possible in case of overload since the bimetal sheet may be unable to simultaneously actuate both of the rocker actuator (33) and the common trip (17).

In a circuit breaker disclosed in U.S. Pat. No. 4,937,548, a thermal actuator (76) is used to displace a lock lever (62) upon deformation so as to release a bell crank lever operator (52). In this case, even a jamming of the actuator and a connection between the contacts upon a neglectful re-push on the switch after overload can be avoided, such an arrangement has not an automatic resetting function and is difficult to install an indicator therein. Moreover, since two thermal actuators are forced against one biasing spring, a tilt of the two thermal actuators may happen.

In U.S. Pat. No. 4,661,667, a double-heart-shaped cam locking mechanism is used to obtain two locking-positions. However, such a switch has not an overload protection function and a status-indicating function.

BRIEF SUMMARY OF THE INVENTION

A main object of the present invention is to provide an overload-protection push-button switch with an automatic resetting mechanism which has a simple structure and a low manufacturing cost and is easy to assemble.

Another object of this invention is to provide an overload-protection push-button switch with an automatic resetting mechanism in which a reset function will be exactly performed in case of meeting a trip condition.

To achieve the above objects of this invention, this invention provides an overload-protection push-button switch with an automatic resetting mechanism comprising:

a housing;

a switching circuit installed in the housing and including a first terminal, a second terminal, a first conducting leaf, and a bimetal sheet; the bimetal sheet having a movable closed end, being able to move to an overload position from a normal position in case of overload, and an open end formed with a first and a second legs for respectively connecting the first terminal and the first conducting leaf; the first conducting leaf being movable between a conduction position in which the second leg of the bimetal sheet is electrically connected to the second terminal and a broken position in which the second leg is disconnected from the second terminal; and an actuating unit installed in the housing and including:

a slidable pressing stem to be actuated to one of a set and a reset positions;

a positioning unit including a cantilever and a heart-shaped stepping recess and being able to position the pressing stem in the set position when the pressing stem is pressed downward;

an enabling supporter being alternatively located in a supporting position and a tripping position in response to the normal position and the overload position of the bimetal sheet respectively;

a rocking lever pivotally supported on the pressing stem along a pivoting axle and formed with a nose for abutting against the first conducting leaf, a toe portion to be supported by the enabling supporter, and a pivoting hole located between the nose and the toe portion so as to be actuated by the pressing stem;

a wrecking bar for departing the cantilever from the heart-shaped stepping recess in case of being actuated by the rocking lever; and a lever-reseating member for abutting against the rocking lever during the returning course of the pressing stem back to its reset position so that the toe portion can be supported by the enabling supporter.

Whereby the toe portion could be enabled by the enabling supporter and the nose can make the first conducting leaf be alternatively located in its conduction position and its broken position in response to the location of the pressing stem in the set position and in the reset position respectively when the bimetal sheet is located in its normal position, and whereby the toe portion could trip and be disabled so as to release the abutment of the nose against the first conducting leaf and to make the wrecking bar depart the cantilever from the heart-shaped stepping recess and thus make the pressing stem automatically return back to its reset position and the first conducting leaf be in a broken position.

By means of the above structure, since the rocking lever is indirectly actuated, the switch can still exactly and transiently trip at the time overload occurs even if the stem jams. Moreover, by virtue of the wrecking bar being actuated by the rocking lever, the switch could automatically return to its reset position after overload. Furthermore, by means of the reseating member, in the stroke of the pressing stem returning to its reset position the toe portion of the rocking lever will return to a position able to be enabled by the enabling supporter once the bimetal sheet is deformed into its normal position.

BRIEF DESCRIPTION OF THE SEVERAL VIEWS OF THE DRAWINGS

In the following, preferred embodiments of the present invention will be described in detail in conjunction with the accompanying drawings, wherein.

DETAILED DESCRIPTION OF THE INVENTION

In the following, an overload-protection push-button switch with an automatic resetting mechanism according to a first preferred embodiment of this invention will be described in reference to drawings.

Figure 1:
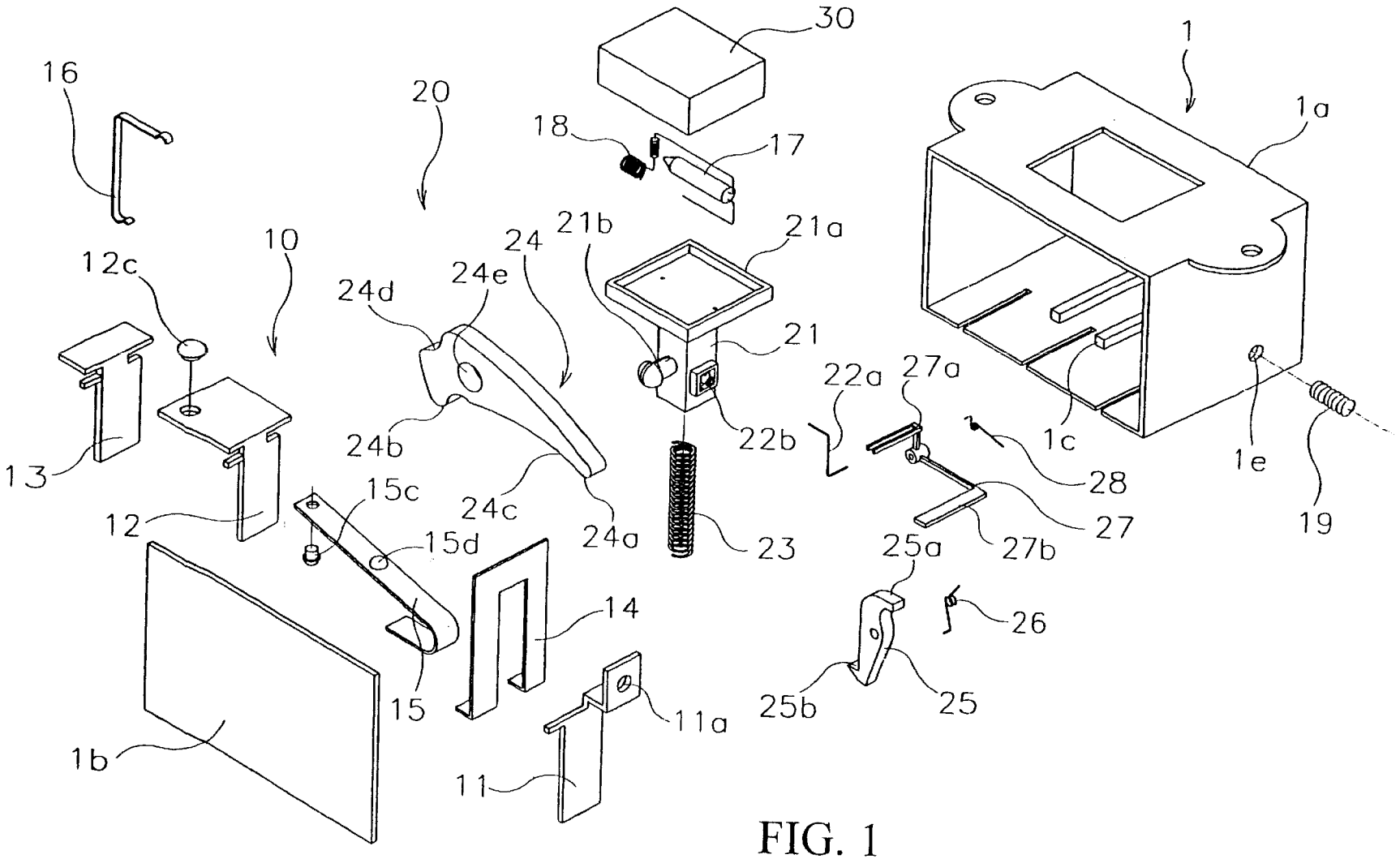
FIG. 1 is an exploded schematic perspective view of an overload-protection push-button switch with automatic reset mechanism in accordance with a first embodiment of this invention.

As shown in the exploded perspective view of FIG. 1, the overload-protection push-button switch with an automatic resetting mechanism according to a first preferred embodiment of this invention generally comprises a switching circuit 10, an actuating unit 20, and a housing 1 for receiving the switching circuit 10 and the actuating unit 20. The housing 1 comprises a main body la and a cover lb. The switching circuit 10 comprises a first terminal 11, a second terminal 12, a third terminal 13, a thermal-deformed bimetal sheet 14, a first conducting leaf 15, a second conducting leaf 16, an indicating lamp 17, and a resistor 18. The actuating unit 20 comprises a pressing stem 21, a positioning unit mainly composed of a cantilever 22*a* and a heart-shaped stepping recess 22*b*, a biasing spring 23 for biasing the pressing stem, a rocking lever 24, an enabling supporter 25, a biasing spring 26 for biasing the enabling supporter 25, a wrecking bar 27, a biasing spring 28 for biasing the wrecking bar 27, a lever-reseating member 29, and a key 30.

The main body 1*a* is provided with a top wall, a bottom wall and three sidewalls, and is formed with a key opening (not indicated with numeral) on the top wall and a number of terminal holes (not indicated with numeral) on the bottom wall. Moreover, a lot of members for guiding or fixing the elements mentioned above are formed integrally with the main body 1*a*. For example, a guiding rod 1*c* for guiding the pressing stem 21 is formed. The cover 1*b* can be installed on the main body 1*a* so as to close the main body 1*a*.

As for the switching circuit 10, each terminal 11, 12, or 13 passes through respective terminal hole from inside of the housing to outside of the housing. The second terminal 12 is provided with a lower contact pad 12*c* inside the housing 1. The thermal-deformed bimetal sheet 14 is of a reversed-U shape having a closed end and an open end. The open end of the bimetal sheet 14 is constructed with two legs respectively being connected to the first terminal 11 and one end of the first conducting leaf 15 (as shown in FIG. 1).

Figure 2:
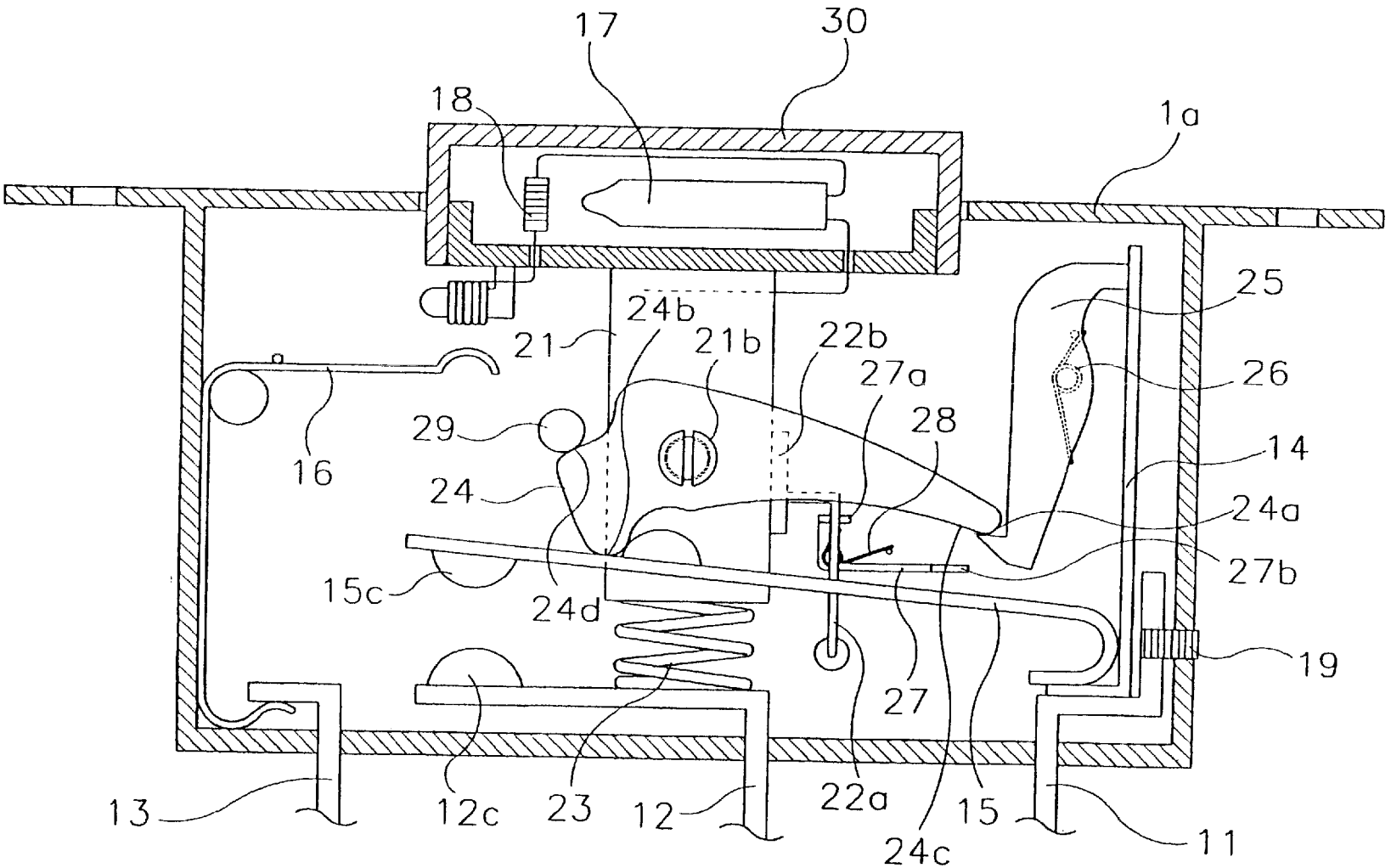
FIG. 2 is an assembled elevation view partly in section of the push-button switch of FIG. 1 in an OFF status.
Figure 4:
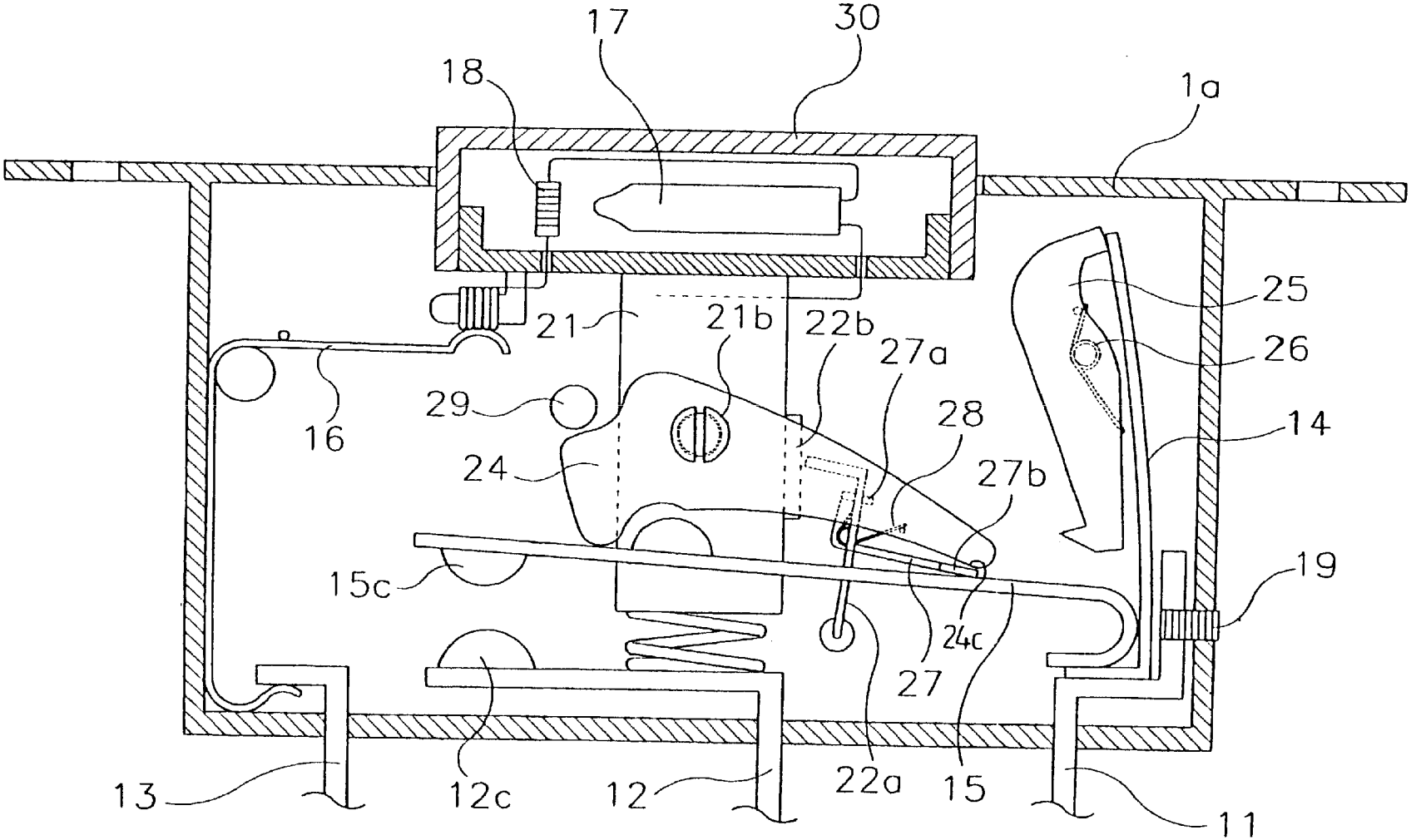
FIG. 4 is a view similar to FIG. 2 but in a trip status before the pressing stem returns to its reset position.

The thermal-deformed bimetal sheet 14 is in a normal position as shown in FIG. 2 if the current pass therethrough is not overloaded, while the said sheet 14 is in an overload position as shown in FIG. 4 if the current pass therethrough is overloaded. Once overload disappears, the bimetal sheet 14 will automatically return to its normal position from its overload position.

The first conducting leaf 15 is fixed and electrically connected to the bimetal sheet 14 (as shown in FIG. 1) at one end thereof, and is provided with an upper contact pad 15*c* at its free end so as to contact a lower contact pad 12*c* of the second terminal 12. Moreover, the first conducting leaf 15 is further provided with a dome 15*d* at its substantially middle portion so as to be abutted by the actuating unit 20.

Figure 3:
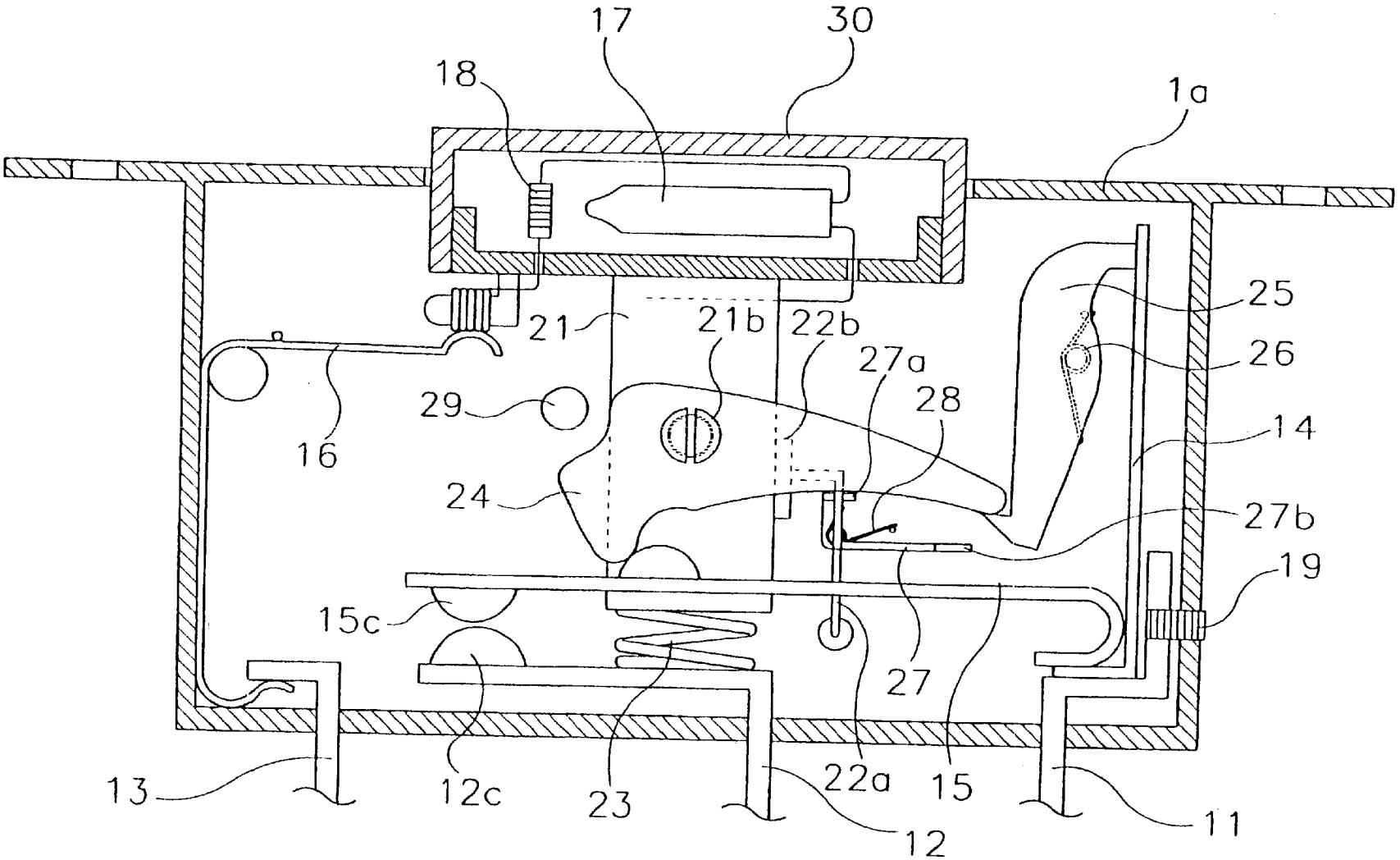
FIG. 3 is a view similar to FIG. 2 but in an ON status.

As shown in FIGS. 1 and 2, the second conducting leaf 16 has a fixed end electrically connected to the third terminal 13 and a free end to be contacted by the resistor 18 (as shown in FIG. 3). The resistor 18 is connected with the indicating lamp 17 and the indicating lamp 17 is electrically connected to the second terminal 12 via the biasing spring 23 by passing through a hole formed in the pressing stem 21.

By means of the above, when the first conducting leaf 15 is actuated by the actuating unit 20 and moves into a conduction position as shown in FIG. 3, an electrical contact is built between the upper and lower contact pads 15*c* and 12*c*. Thus, the power from the first terminal 11 will be transmitted to the second terminal 12 and to the third terminal 13 via the indicating lamp 17 so as to light up the indicating lamp 17.

As shown in FIGS. 1 and 2, the main body la is formed with a hole 1*e* on a side wall in the neighborhood of the first terminal 11. The first terminal 11 is provided with a screw hole 11*a* in an extending fin substantially parallel to the bimetal sheet 14. By means of engaging an adjusting screw 19 into the screw hole 11*a*, the inner end of the screw 19 could push against one leg of the bimetal sheet 14 so as to adjust the position of the bimetal sheet 14.

As shown in FIGS. 1 and 2, the pressing stem 21 of the actuating unit 20 is of a square hollow shape in which a biasing spring 23 is received and thus the pressing stem 21 is biased upward to a reset position (as shown in FIG. 2) by the biasing spring 23. The top end of the pressing stem 21 is provided with a tray 21*a* for receiving the indicating lamp 17 and the resistor 18. The tray 21*a* is formed with two holes (not indicated with numeral) for the pass of the pins of the lamp 17 and the resistor 18. The pressing stem 21 is provided with a snap shaft 21*b* on its front side surface for pivoting the rocking lever 24 and with a heart-shaped stepping recess 22*b* on its right side surface. The heart-shaped stepping recess 22*b* is formed with an upper locating point.

The cantilever 22*a* of the positioning unit is constructed by a steel wire having proper flexibility and rigidity. A fixed end of the cantilever 22*a* is fixed on the main body 1*a* and a moving end thereof is inserted into the heart-shaped stepping recess 22*b*. The detailed description of the heart-shaped stepping recess 22*b* is disclosed in the U.S. Pat. No. 5,786,742 and thus is omitted herein. The content of the U.S. Pat. No. 5,786,742 is incorporated herein for reference. The moving end of the cantilever 22*a* will move into the upper locating point when the pressing stem 21 is pressed-downward and thus retain the pressing stem 21 in a set position. However, if the pressing stem 21 is pushed again, the moving end of the cantilever 22*a* will escape the upper locating point and release the pressing stem 21 back to the reset position.

The rocking lever 24 is formed with a pivoting hole 24*e* so as to pivot on the snap shaft 21*b*. The rocking lever 24 is further formed at its one end with a toe portion 24*a* and an arch portion 24*c*, and formed at the other end with a nose 24*b* and a reseating shoulder 24*d*. The arch portion 24*c* is constructed by a rim of the rocking lever 24 which is located between the toe portion 24*a* and the pivoting hole 24*e*, and is used to push the wrecking bar 27. The nose 24*b* is used to abut against the first conducting leaf 15 when the pressing stem 21 is moved to the reset position in case the toe portion 24*a* is supported by the enabling supporter 25. The reseating shoulder 24*d* is constructed by a rim of the rocking lever 24 which is located upper than the nose 24*b*.

The enabling supporter 25 is provided with an abutting surface 25*a* and a supporting portion 25*b* respectively located at two ends thereof. The enabling supporter 25 is pivoted on the housing 1 along an axis parallel to the pivoting axis of the rocking lever 24, and is biased by a biasing spring 26 to a supporting position as shown in FIG. 2. At such a supporting position, the abutting surface 25*a* abuts against the closed end of the bimetal sheet 14 and the supporting portion 25*b* supports the toe portion 24*a*. Thus, the rocking lever 24 is enabled to actuate the first conducting leaf 15.

The wrecking bar 27 is pivoted on the housing 1 along an axis parallel to the pivoting axis of the rocking lever 24 and is provided with a wrecking portion 27*a* and a handle portion 27*b* respectively located at two ends thereof The wrecking bar 27 is biased by a biasing spring 28 toward a suspending position in which the moving end of the cantilever 22*a* is inserted into the heart-shaped stepping recess 22*b*. The wrecking portion 27*a* extends in a direction parallel to the axis of the wrecking bar 27 and substantially vertical to the cantilever 22*a*, and is formed with an opening. The cantilever 22*a* is received in the opening and thus can be moved by the wrecking portion 27*a*. The handle portion 27*b* extends to a position in which the arch portion 24*c* of the rocking lever 24 will pass in the stroke the switch trips due to overload.

The lever-reseating member 29 as shown in FIGS. 2 and 3 is fixedly provided on the main body 1*a* and extends at a direction parallel to the pivoting axis of the rocking lever 24. The lever-reseating member 29 is located in a position in which the reseating shoulder 24*d* will be stopped when the pressing stem 21 is returning to its reset position until the toe portion 24*a* of the rocking lever 24 moves into a position to be supported by the supporting portion 25*b* of the enabling supporter 25.

By means of the above construction, as shown in FIG. 2, when the bimetal sheet 14 is in a normal position, the enabling supporter 25 is biased by the biasing spring 26 into a supporting position and the toe portion 24*a* is to be supported by the supporting portion 25*b* in an enabling position. Moreover, since the cantilever 22*a* is not pulled out of the heart-shaped stepping recess 22*b*, the rocking lever 24 will move downward counterclockwise rotates around the toe portion 24*a* when the pressing stem 21 is pushed downward so that the nose 24*b* will force the first conducting leaf 15 to move downward until the upper and the lower contact pads 15*c* and 12*c* contact together. On the other side, when the pressing stem 21 is pushed again and thus biased upward by the biasing spring 23 into the reset position, the rocking lever 24 will move upward and rotate around the toe portion 24*a*. The nose 24*b* in turn releases the abutment against the first conducting leaf 15 and thus the upper contact pad 15*c* separates from the lower contact pad 12*c* due to the resilience of the first conducting leaf 15. Therefore, the nose 24*b* will alternatively make the first conducing leaf 15 move into a conduction position as shown in FIG. 3 and a broken position as shown in FIG. 2 in response to the movement of the pressing stem 21 into its set position and its reset position.

However, when the bimetal sheet 14 is deformed to an overload position as shown in FIG. 4 due to overload, the enabling supporter 25 will rotate to a trip position upon the push of the closed end of the bimetal sheet 14 at the abutting surface 25*a*, and thus the supporting portion 25*b* departs from the toe portion 24*a*. Consequently, upon the resilience of the first conducting leaf 15, the nose 24*b* is pushed upward and the toe portion 24*a* rotates clockwise to a disabling position around the snap shaft 21*b*, in which the first conducting leaf 15 is at a broken position and the upper contact pad 15*c* separates from the lower contact pad 12*c*. On the other side, during the rotation of the rocking lever 24, the handle portion 27*b* of the wrecking bar 27 will be pushed by the arch portion 24*c*. Thus, the wrecking bar 27 rotates into a pulling position in which the moving end of the cantilever 22*a* is pulled out of the heart-shaped stepping recess 22*b*. Such situation is shown in FIG. 4.

By means of the movement of the moving end of the cantilever 22*a* out of the heart-shaped stepping recess 22*b*, the pressing stem 21 is dislocated from set position and returns to its reset position upon the action of the biasing spring 23. In the meanwhile, the rocking lever 24 is moved upward and the shoulder 24*d* abuts against the lever-reseating member 29 so that the toe portion 24*a* rotates counterclockwise into a position to be supported and enabled by the supporting portion 25*b*. Once the bimetal sheet 14 is deformed back to its normal position, the toe portion 24*a* is supported again. Thus, the described switch has a function of automatic reset.

As shown in FIGS. 1 and 4, before the bimetal sheet 14 returns back to its normal position, the upper contact pad 15*c* will not come into contact with the lower contact pad 12*c* even if the key 30 and the pressing stem 21 are pushed downward. This is because the toe portion 24*a* is not supported by the supporting portion 25*b* of the enabling supporter 25 yet and thus the nose 24*b* fails to force the first conducting leaf 15 downward. Thus, a reliable overload protection is available.

As for the second conducting leaf 16, furthermore, the free end thereof will depart from the resistor 18, as shown in FIG. 2, when the pressing stem 21 returns back to its reset position upon the biasing of the biasing spring 23. Thus, the second conducting leaf 16 is also in a broken position.

Therefore, the push-button switch according to this invention is provided with an overload-protection function as well as an automatic resetting function in case of overload. And, since the whole motion is transmitted via the rocking lever 24, the trip action and the automatic resetting action in the switch are assured.

Figure 5:
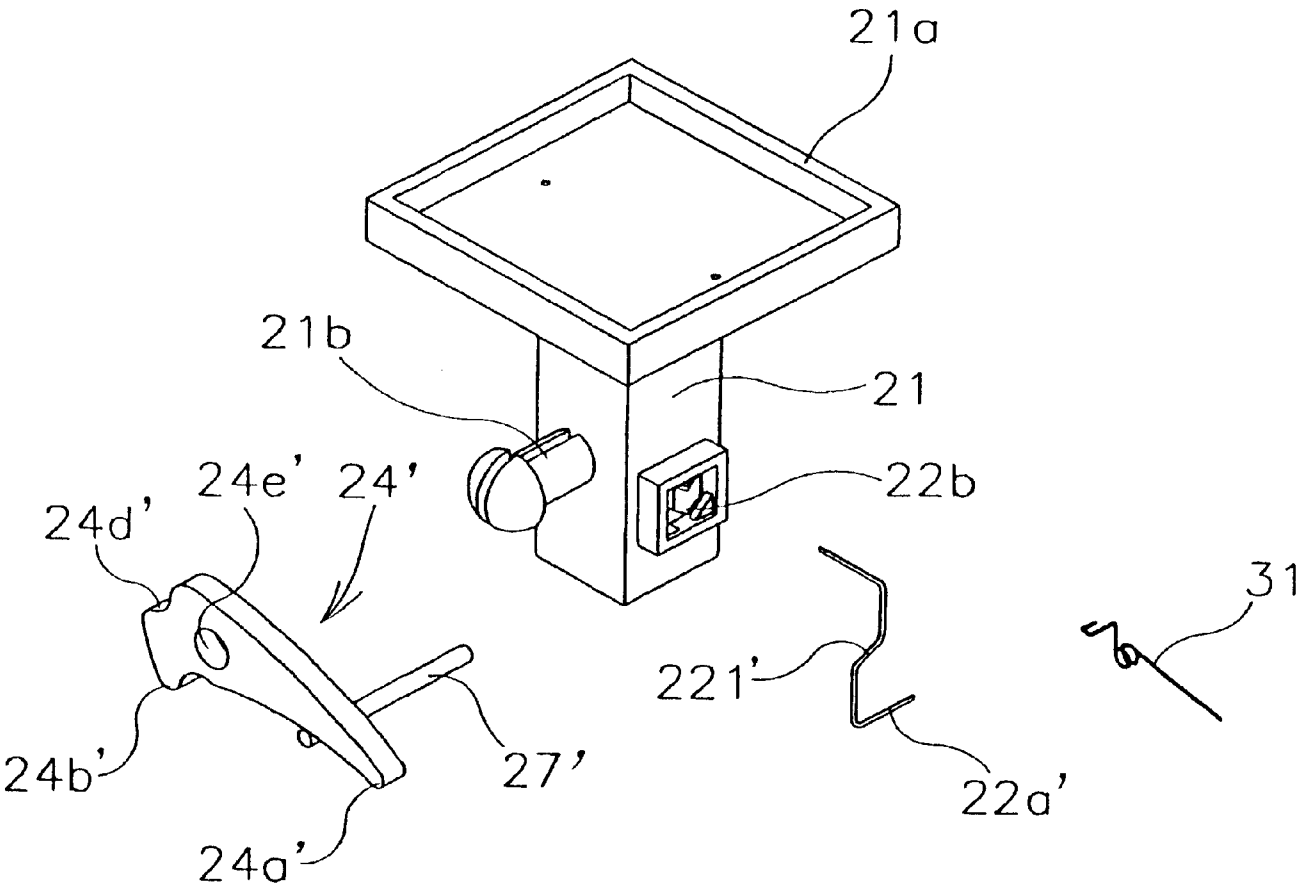
FIG. 5 is an exploded schematic perspective view showing a part of the elements in a switch according to a second embodiment of this invention, which is a modification of the first embodiment.
Figure 6:
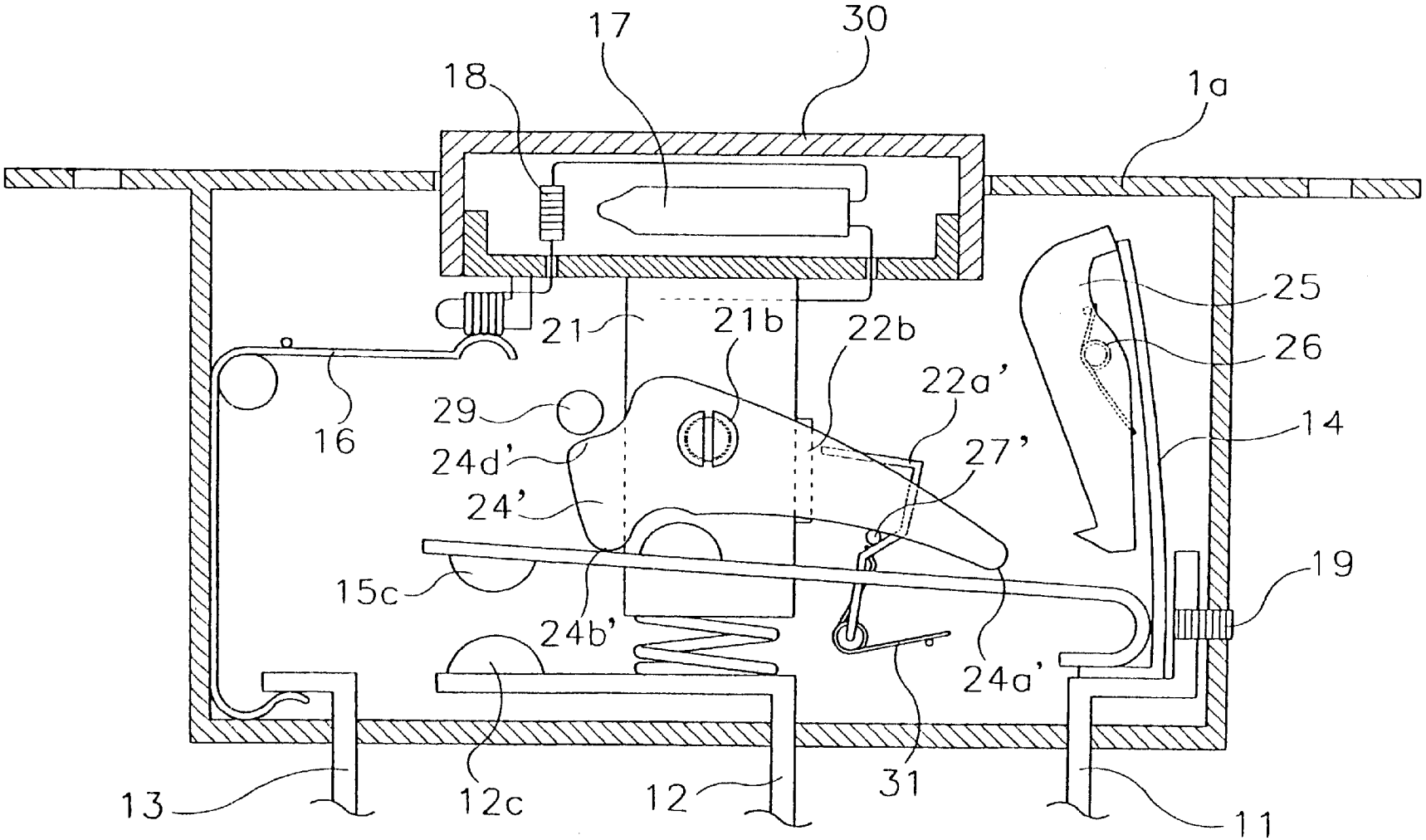
FIG. 6 is an assembled elevation view partly in section of the push-button switch of FIG. 5 in a trip status before the pressing stem returns to its reset position.

FIGS. 5 and 6 show an actuating unit of the overload-protection push-button switch according to a second embodiment of this invention. However, since there are a lot of members identical to those in the first embodiment and thus only the different parts are shown in FIG. 5 and described herein. Moreover, the element corresponding to that in the first embodiment is signified with the same numeral adding of a sign of '. The main difference between the first and the second embodiments resides in the substitution of a cross bar 27' for the previous wrecking bar 27.

As shown in FIGS. 5 and 6, the cross bar 27' vertically extends from one side surface of the rocking lever 24' to and over the cantilever 22*a*' along an axis parallel to the snap shaft 21*b*. Moreover, the cantilever 22*a*' is formed with an oblique portion 221' located in a position the cross bar 27' will pass. The oblique portion 221' tilts far way from the heart-shaped stepping recess 22*b* from a lower portion to an upper portion. And, the cantilever 22*a*' is biased by a biasing spring 31 to an inserting position. By means of such an arrangement, the moving end of the cantilever 22*a*' will depart from the heart-shaped stepping recess 22*b* when the cross bar 27' rotates downward in case the toe portion 24*a* is not supported. Consequently, the pressing stem 21 will automatically return back to its reset position. The structure in this embodiment is simpler than that in the first embodiment.

Figure 7:
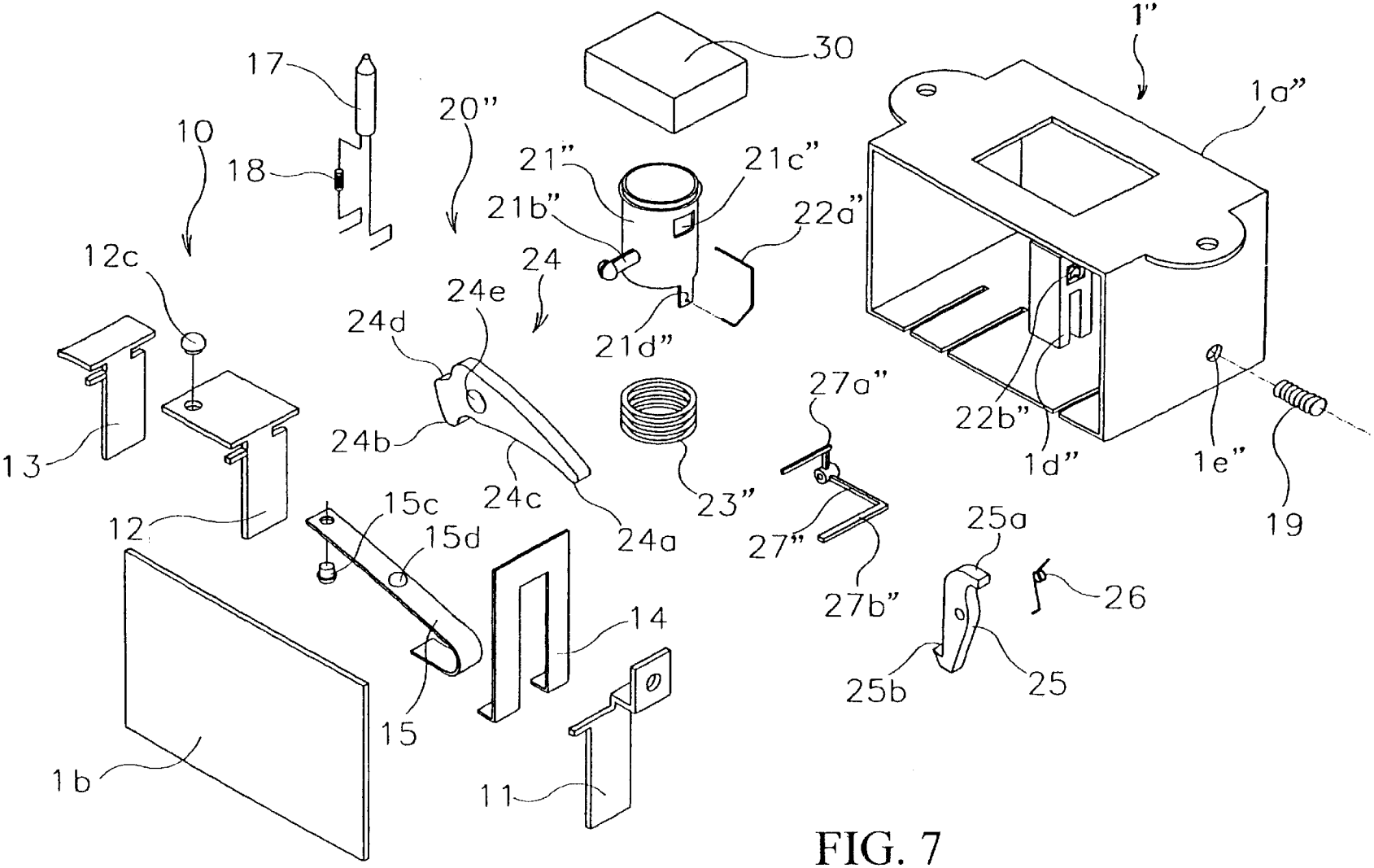
FIG. 7 is an exploded schematic perspective view of an overload-protection push-button switch with automatic reset mechanism in accordance with a third embodiment of this invention.
Figure 8:
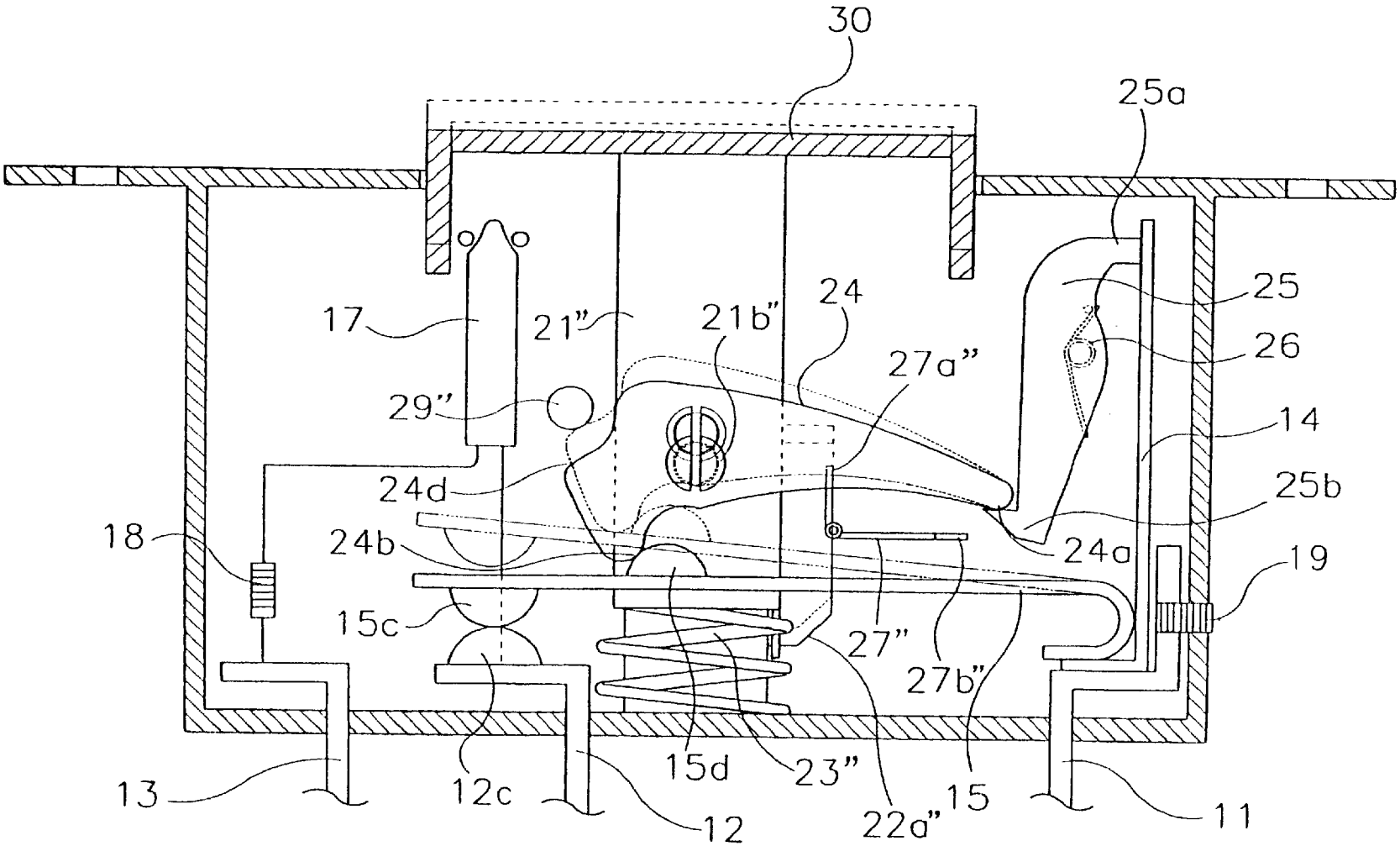
FIG. 8 is an assembled elevation view partly in section of the push-button switch of FIG. 7 in an OFF and an ON status respectively drawn by dotted lines and solid lines.
Figure 9:
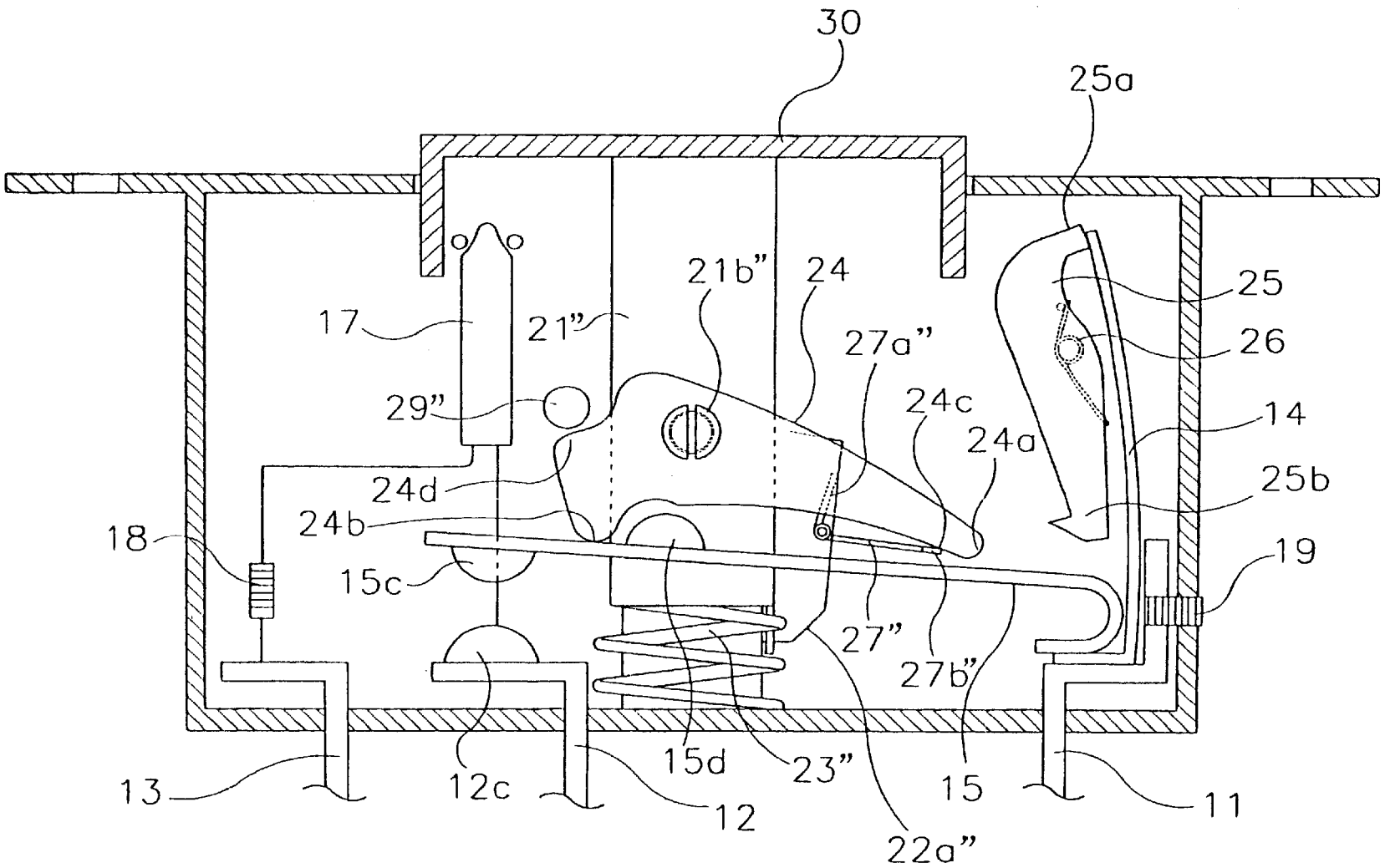
FIG. 9 is an assembled elevation view partly in section of the push-button switch of FIG. 7 in a trip status before the pressing stem returns to its reset position.

FIGS. 7 to 9 show a switch according to a third embodiment of this invention. The element identical to that in the first embodiment is signified with the same numeral and its description is omitted while the element corresponding to that in the first embodiment is signified with the same numeral adding of a sign of ".

As shown in FIGS. 7 and 8, the main difference between the third embodiment and the first embodiment resides in the substitution of a cylindrical pressing stem 21" for the pressing stem 21 and the provision of the heart-shaped stepping recess 22*b*" on a pillar 1*d*" in lieu of the pressing stem 21. The pillar 1*d*" extends from the main body 1*a*" and is used for guiding the movement of the cylindrical pressing stem 21". The pressing stem 21" is formed with a hole 21*c*"for the pass of a moving end of a cantilever 22*a*" and a pin hole 21*d*" for sustaining a fixed end of the cantilever 22*a*". As a result, the cantilever 22*a*" is mounted on the pressing stem 21" and the heart-shaped stepping recess 22*b*" is provided on the main body 1*a*". Moreover, the indicating lamp 17 and the resistor 18 are serially connected and mounted on the second terminal 12 and the third terminal 13 and thus the second conducting leaf 16 in the first embodiment is omitted. Furthermore, a wrecking bar 27" substitutes for the wrecking bar 27 in the first embodiment. However, the wrecking bar 27" is not provided with an opening at its wrecking portion 27*a*". Moreover, the biasing spring 28 in the first embodiment is omitted in this embodiment. Such an arrangement is available due to the fact that the moving end of the cantilever 22*a*" will be normally sustained in a position inserting into the heart-shaped stepping recess 22*b*".

FIG. 8 shows an ON status and an OFF status of the first conducting leaf 15 and the rocking lever 24, which are drown respectively by solid lines and by dotted lines. FIG. 9 shows a situation the switch tripped due to overload. Since the operation and details of the third embodiment are substantially identical to those in the first embodiment, they are omitted herein.

According to the above third embodiment, it is understood that the concept of this invention is adapted to a changed positioning mechanism. Moreover, it is expected that the enabling supporter 25 is omissible if the toe portion 24*a* of the rocking lever 24 can be actuated in response to the deformation of the bimetal sheet 14. For example, the toe portion can extend over the rim of the closed end of the bimetal sheet 14. In such a case, the rim of the closed end would act as the supporting portion so as to enable the rocking lever 24 to function. Once the bimetal sheet 14 is deformed, the rim, i.e., the supporting portion, will depart from the toe portion 24*a* so as to disable the rocking lever 24 from function.

While the present invention is described by way of preferred embodiments, it is understood that the embodiments are used only to illustrate the technical concept of the present invention without limiting the scope thereof. It is therefore intended to show that all modifications and alterations that are readily apparent to those skilled in the art are within the scope as defined in the appended claims.

What is claimed is:

1. An overload-protection push-button switch with an automatic resetting mechanism, comprising:

a housing;

a switching circuit installed in the housing, the switching circuit including:

a first terminal, a second terminal, a first conducting leaf, and a bimetal sheet, having a movable closed end which is able to move to an overload position from a normal position in case of overload, and an open end formed with a first and a second legs which connect the first terminal and the first conducting leaf, respectively; the first conducting leaf being movable between a conduction position at which the second leg of the bimetal sheet is electrically connected to the second terminal and a broken position at which the second leg is disconnected from the second terminal; and an actuating unit installed in the housing, the actuating unit including:

a slidable pressing stem actuated to one of a set and a reset positions;

a positioning unit including a cantilever and a heart-shaped stepping recess and being able to position the pressing stem in the set position when the pressing stem is pressed downward;

an enabling supporter connected to the closed end of the bimetal sheet, the enabling supporter being alternatively located in a supporting position and a tripping position in response to the normal position and the overload position of the bimetal sheet, respectively;

a rocking lever pivotally supported on the pressing stem along a pivoting axle provided on the pressing stem; the rocking lever being formed with a nose for abutting against the first conducting leaf, a toe portion to be supported by the enabling supporter, and a pivoting hole located therebetween for receiving the pivoting axle, whereby the rocking lever is actuated by the pressing stem;

a wrecking bar for departing the cantilever from the heart-shaped stepping recess when being actuated by the rocking lever; and a lever-reseating member for abutting against the rocking lever in a stroke of the pressing stem returning back to its reset position at which the toe portion is supported by the enabling supporter;

whereby when the bimetal sheet is located in its normal position, the toe portion is enabled by the enabling supporter and the nose makes the first conducting leaf be alternatively located in its conduction position and its broken position in response to the location of the pressing stem at its set position and its reset position, respectively, and whereby when the bimetal sheet is deformed to its overload position, the toe portion trips and is disabled so as to release the nose from abutting against the first conducting leaf and to make the wrecking bar depart the cantilever from the heart-shaped stepping recess, thereby the pressing stem automatically returns back to its reset position at which the first conducting leaf is in its broken position.

2. The switch as claimed in claim 1, wherein the wrecking bar is provided with a wrecking portion at one end thereof and a handle portion at the other end thereof, and wherein the wrecking bar is configured such that the wrecking portion will make the cantilever depart from the heart-shaped stepping recess by means of the rocking lever acting on the handle portion when the bimetal sheet is deformed to its overload position.

3. The switch as claimed in claim 2, wherein the handle portion of the wrecking bar extends to a position at which a rim of the rocking lever adjacent to the toe portion will pass at the time the toe portion is disabled so as to be actuated by the rim.

4. The switch as claimed in claim 2, wherein the wrecking bar is integrally formed with the rocking lever and extends from the rocking lever to the cantilever and wherein the cantilever is formed with an oblique portion to be abutted by the wrecking bar so as to depart from the heart-shaped stepping recess.

5. The switch as claimed in claim 1, wherein the enabling supporter is a lever pivotally mounted on the housing and having an abutting surface at one end thereof to be actuated by the bimetal sheet and a supporting portion at the other end to support the toe portion.

6. The switch as claimed in claim 1, wherein the switching circuit further comprises a third terminal and an indicating lamp serially connected between the third terminal and the second terminal and wherein the pressing stem is provided with a space for receiving the indicating lamp.

* * * * *